United States Patent [19]

Eggers

[11] Patent Number: 4,607,990

[45] Date of Patent: Aug. 26, 1986

[54] UNIPAK TIE-DOWN SYSTEM

[75] Inventor: Alfred G. Eggers, North Strabane Township, Washington County, Pa.

[73] Assignee: Westinghouse Electric Corp., Pittsburgh, Pa.

[21] Appl. No.: 664,449

[22] Filed: Oct. 24, 1984

[51] Int. Cl.[4] ..... B61D 3/16

[52] U.S. Cl. ..... 410/2; 410/77; 410/94; 410/101; 248/499

[58] Field of Search ..... 220/325, 327, 328; 410/2, 47, 48, 52, 77, 94, 96, 101, 156, 90, 95, 49; 292/256.71, 256.73; 411/396, 397, 400, 427; 248/499, 500

[56] References Cited

U.S. PATENT DOCUMENTS

| | | | |
|---|---|---|---|
| 1,326,882 | 12/1919 | Stratton | 220/327 |
| 4,431,352 | 2/1984 | Andrews | 410/101 |
| 4,487,537 | 12/1984 | Morse | 410/47 |

FOREIGN PATENT DOCUMENTS

| | | | |
|---|---|---|---|
| 1007460 | 10/1965 | United Kingdom | 105/369 A |

*Primary Examiner*—Robert B. Reeves
*Assistant Examiner*—Dennis C. Rodgers
*Attorney, Agent, or Firm*—Joel Petrow

[57] ABSTRACT

Disclosed is a system for handling, transporting, and disposing of low level radioactive waste materials which utilizes reusable, separate, and removable lifting means and tie-down means. Mechanical design of the lifting means and hold-down means prevent the inadvertent use of either for the improper purpose.

3 Claims, 4 Drawing Figures

UNIPAK TIE-DOWN SYSTEM

BACKGROUND OF THE INVENTION

Regulations require transportation casks for low level nuclear waste to be designed to withstand 10 g. horizontal loads in the vehicle axis, 5 g. loads perpendicular to that axis and 2 g. vertical loads. In addition, lifting devices must be covered or rendered unusable for tying down the transportation cask.

Previous transportation casks used attached lifting and tie-down lugs which were integral and non-removal parts of the cask. When the cask is lifted, the die-down lugs have to be locked or covered and when the cask is tied down, the lifting lugs have to be locked or covered to prevent inadvertent use. One alternative had been to design a massive lug that could be used for either tie-down or lifting. Neither of these approaches is economical in a disposable cask designed for a single use.

SUMMARY OF THE INVENTION

Problems associated with the above-described integral lifting lugs and tie-down lugs for a disposable radioactive waste container are overcome by the present invention without resorting to an expensive integral combination handling and tie-down lug. The invention utilizes reusable components which mate with rather than are part of the cask. The separate lifting and tie-down lugs are not only reusable, but are designed so that use of one precludes the inadvertent use of the other because of purposely designed mechanical interference.

DESCRIPTION OF THE PREFERRED EMBODIMENT

Figure 1:
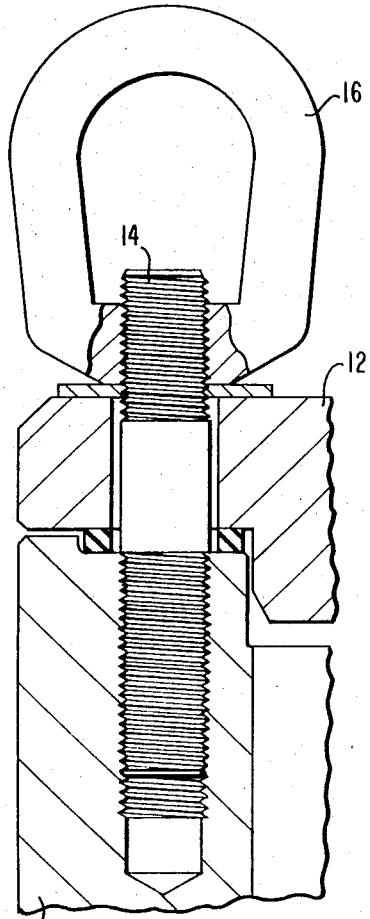
FIG. 1 is a sectional view of the cask lid, stud, and lifting lug for handling of the waste cask.

Referring to FIG. 1, a generally cylindrical disposal cask 10 with an open top is filled with low level radioactive waste material. A lid 12 that mates with the open cask is placed on top to close the cask. Studs 14 are fastened into the cask and pass through the lid. The studs may be fastened to the cask either by welding or the use of matching threads. In the preferred embodiment, the studs occupy four of sixteen locations around the lid periphery. Lifting lugs 16 are fastened to the portion of the stud protruding through the lid by the use of matching threads.

Figure 2:
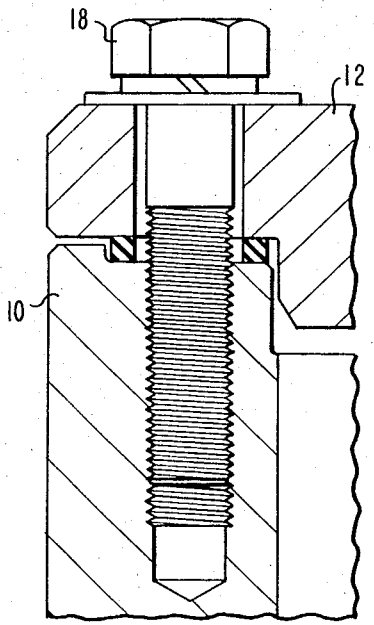
FIG. 2 is a sectional view of the cask, lid, and bolt as a means for securing the led to the cask.

The remaining twelve of sixteen positions around the lid periphery accommodate means for securing the lid to the cask such as by bolts 18 shown in FIG. 2. The cask can then be lifted by the lifting lugs and placed upon the vehicle for transportation.

Figure 3:
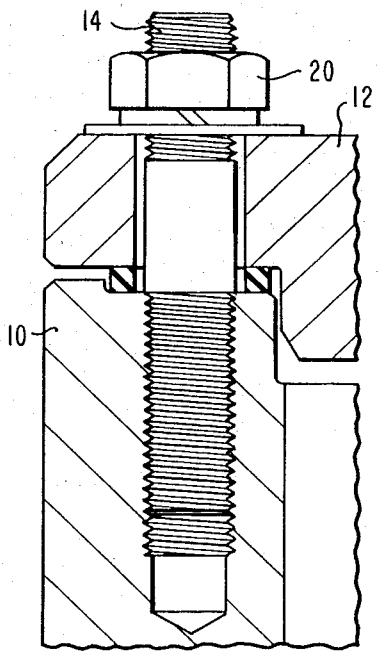
FIG. 3 is a sectional view of the cask, lid, stud, and nut as a means for securing the lid to the cask.

After the cask is placed upon the transportation vehicle, the lifting lugs 16 are removed from the threaded studs and replaced by means for securing the lid to the casks such as nuts 20 shown in FIG. 3. The use of studs 14 and nuts 20 for securing the lid to the cask as shown in FIG. 3 is also an alternative means for securing the lid to the cask in the other twelve locations around the periphery of the lid.

Figure 4:
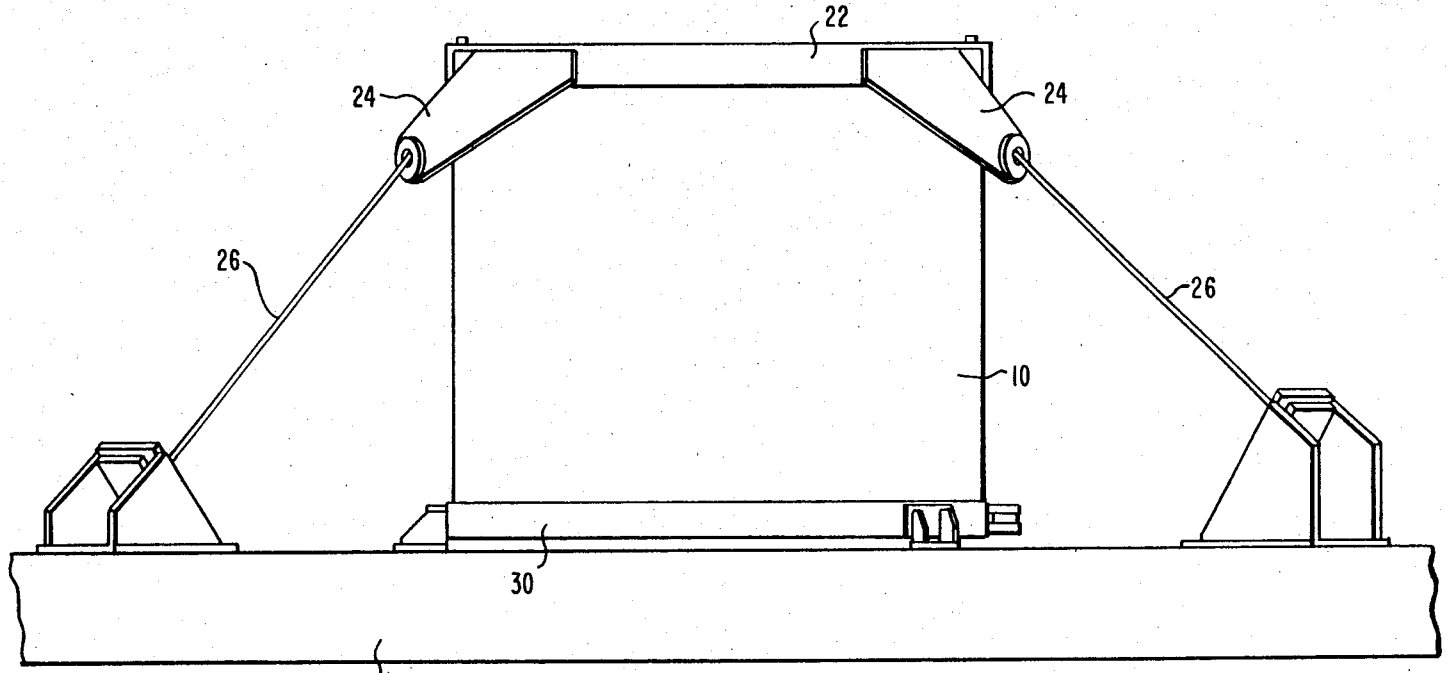
FIG. 4 is an elevational view of the waste cask and hold-down system for transportation including the hold-down ring and lower anchor means.

As shown in FIG. 4, hold-down ring 22 containing tie-down lugs 24 is then placed over the lid. The hold-down ring has cavities on the inside of the ring large enough to accept the protruding portion of the studs 14 and the lid securing means, either bolts 18 or nuts 20 on the studs, but small enough to not allow placement of the ring 22 on the cask lid while the lifting lugs 16 are in place.

The hold-down ring 22 with its tie-down lugs 24 is designed such that it cannot be used to lift the waste cask. Any attempt to do so will merely remove the ring from the waste cask. Similarly, the design of the lifting lugs 16 is such that they cannot be used for tie-down of the container during shipment.

In addition to the hold-down ring which has four tie-down lugs 24 which mate with adjustable tension members 26 anchored to the bed of the vehicle 28, there is also a lower anchor ring 30 that surrounds the bottom of the cask 10 to prevent sliding of the lower end of the cask. This ring 30 may be in multiple segments which can be compressed against the cask. The lower anchor ring 30 is then fastened to the bed of the transportation vehicle 28.

Removal of the cask requires that the hold-down ring 22 be first removed from the top of the cask, nuts 20 that are upon the four stud locations be removed, and the lifting lugs 16 be threaded onto the exposed portion of the threaded studs. An attempt to lift the cask by the hold-down lugs 24 contained on the hold-down ring 22 will merely remove the ring from the cask 10 and not lift the cask.

Once the cask is placed in the desired disposal location, the lifting lugs may be removed for reuse and the exposed threaded portion of the studs replaced with matching threaded nuts.

I claim:

1. An apparatus for holding waste material, suitable for handling, transporting, and disposal comprising:

an open cask for accepting the waste material;

a lid that mates with the open cask to close the cask;

studs fastened into the cask and passing through the lid;

means for securing the lid to the cask;

lifting lugs fastened onto the portion of the stud protruding through the lid; and a hold-down ring with tie-down lugs for use in securing said cask during transport with said lifting lugs removed, said ring having cavities sized to accept protruding stud portions and lid securing means when placed over the lid but sized not to accept lifting lugs.

2. An apparatus for holding waste material, suitable for handling, transporting, and disposal comprising:

an open cask for accepting the waste material;

a lid that mates with the open cask to close the cask;

studs fastened into the cask and passing through the lid;

means for securing the lid to the cask;

lifting lugs fastened onto the portion of the stud protruding through the lid;

a hold-down ring with tie-down lugs for use in securing said cask during transport with said lifting lugs removed, said ring having cavities sized to accept protruding stud portions and lid securing means when placed over the lid but sized not to accept lifting lugs; and lower anchor means capable of being fastened to a vehicle that surrounds the bottom circumference of the cask.

3. The apparatus of claim 2 wherein the lower anchor means is comprised of more than one segment with means for compressing said segments against the cask.

* * * * *